US006138344A

United States Patent [19]

Roessler et al.

[11] Patent Number: 6,138,344

[45] **Date of Patent: *Oct. 31, 2000**

[54] METHODS OF MANUFACTURING A MAGNETIC DEVICE AND TOOL FOR MANUFACTURING THE SAME

[75] Inventors: Robert Joseph Roessler, Rowlett; William Lonzo Woods, Kaufman, both of Tex.

[73] Assignee: Lucent Technologies Inc., Murray Hill, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/908,887

[22] Filed: Aug. 8, 1997

[51] Int. Cl.[7] ..... H01F 7/06

[52] U.S. Cl. ..... 29/606; 29/609

[58] Field of Search ..... 29/606

[56] References Cited

U.S. PATENT DOCUMENTS 5,345,670 9/1994 Pitzele et al. ..... 29/606
5,634,262 6/1997 O'Donnell ..... 29/606

FOREIGN PATENT DOCUMENTS 0 741 395 A1 11/1996 European Pat. Off. .

*Primary Examiner*—David A. Scherbel
*Assistant Examiner*—Daniel G. Shanley

[57] ABSTRACT

Methods of manufacturing a magnetic device and a manufacturing tool employing the methods. One of the methods includes the steps of: (1) providing a planar winding assembly and (2) employing an automated pick and placement tool adhesively to secure a first core-portion of a magnetic core to a second core-portion thereof proximate the planar winding assembly, the magnetic core adapted to impart a desired magnetic property to the planar winding assembly, the first and second core-portions being secured to said planar winding assembly without substantial compressive forces.

23 Claims, 4 Drawing Sheets

METHODS OF MANUFACTURING A MAGNETIC DEVICE AND TOOL FOR MANUFACTURING THE SAME

TECHNICAL FIELD OF THE INVENTION

The present invention is directed, in general, to magnetic devices and, more specifically to methods of manufacturing magnetic devices of relatively high density and small footprint that are highly automated and efficient.

BACKGROUND OF THE INVENTION

A magnetic device uses magnetic material arranged to shape and direct magnetic flux in a predetermined manner to achieve a desired electrical performance. The magnetic flux provides a medium for storing, transferring or releasing electromagnetic energy.

Magnetic devices most typically include a core having a predetermined volume and composes of a magnetic material (e.g., ferrite) having a magnetic permeability greater than that of a surrounding medium (e.g., air). A plurality of windings of a desired number of turns and carrying an electrical current surround, excite and are excited by the core (or legs thereof). Because the magnetic core has a relatively high permeability, magnetic flux produced by the windings is confined almost entirely to the core. The flux follows the path the core defines; flux density is essentially consistent over the uniform cross-sectional area of the core.

Magnetic devices are often used to suppress electromagnetic interference ("EMI"). When used in the suppression role, the efficiency with which a magnetic device stores and releases electrical power is a lesser concern. However, magnetic devices are also frequently employed to transmit, convert or condition electrical power (so-called "power magnetic devices"). When so employed (often in the environment of power supplies for electronic equipment), magnetic performance and efficiency become major concerns.

As with other types of electronic components, there is a trend in the design of power magnetic devices toward achieving increased power and volumetric density and lower device profile. To achieve higher power, the resistance of the power magnetic device must be reduced, typically by increasing the cross-sectional area of the electrical member forming the device windings. To increase the density of the power magnetic device, the windings are usually made relatively thin in the region constituting the core of the device to optimize the electrical member resistance.

Another problem associated with present-day power magnetic devices is the lack of planarity of the device terminations. Because of the need to optimize the winding thickness of the power magnetic device to provide the requisite number of turns while minimizing the winding resistance, the thickness of the electrical member forming each separate winding of the device is often varied. Variation in the winding thickness often results in a lack of planarity of the device terminations, an especially critical deficiency when the device is to be mounted onto a surface of a substrate, such as a printed circuit board ("PCB") or printed wiring board ("PWB").

A surface-mountable power magnetic device is disclosed in U.S. patent application Ser. No. 08/434,485, filed on May 4, 1995, to Pitzele, et al., entitled "Power Magnetic Device Employing a Leadless Connection to a Printed Circuit Board and Method of Manufacture Thereof," commonly assigned with the present invention and incorporated herein by reference. The surface-mountable power magnetic device includes a multi-layer circuit containing a plurality of windings disposed in layers and a magnetic core mounted proximate the plurality of windings. The magnetic core is adapted to impart a desired magnetic property to the plurality of windings. The plurality of windings and the magnetic core are substantially free of a surrounding molding material to allow the magnetic device to assume a smaller overall device volume. The surface-mountable power magnetic device also includes an improved termination or lead structure that attains electrical isolation and thermal conductivity without requiring a molding compound.

In a related U.S. patent application, Ser. No. 08/791,082, filed on Jan. 24, 1997, to Pitzele, et al., entitled "Power Magnetic Device Employing a Compression-Mounted Lead to a Printed Circuit Board and Method of Manufacture Thereof," commonly assigned with the present invention and incorporated herein by reference, a manual method of manufacturing the power magnetic device is disclosed. After the multi-layer flex circuit is prepared, an epoxy adhesive is applied to a first core-half of the magnetic core and the first core-half is joined to a second core-half. The magnetic core-halves are twisted to ring the adhesive and create a very minute interfacial bond line between the first and second core-halves. The magnetic core are then held together using mechanical compression (e.g., with a clip or clamp) while the epoxy adhesive between the core halves Cures.

While the methods of Pitzele, et al., provide reliable processes of manufacturing a power magnetic device, innovative pick and place assembly techniques may be applied with respect to core assembly to reduce the cost and increase the manufacturing yield for such power magnetic devices. In view of the compactness of the present power magnetic devices and the competitive pressures on price, an increase in manufacturing efficiency is highly desirable.

Accordingly, what is needed in the art is a method of manufacturing magnetic devices (including power magnetic devices) having a relatively high density and small footprint that addresses the need for automation and reliability in the production of such magnetic devices.

SUMMARY OF THE INVENTION

To address the above-discussed deficiencies of the prior art, the present invention provides methods of manufacturing a magnetic device and a manufacturing tool employing the methods. One of the methods includes the steps of: (1) providing a planar winding assembly and (2) employing an automated pick and placement tool adhesively to secure a first core-portion of a magnetic core to a second core-portion thereof proximate the planar winding assembly, the magnetic core adapted to impart a desired magnetic property to the planar winding assembly, the first and second core-portions being secured to said planar winding assembly without substantial compressive forces.

The present invention therefore introduces the broad concept of employing an automated pick and placement manufacturing process and tool to adhesively secure core-portions to the planar winding assembly. The magnetic device is, therefore, constructed using a substantially automated process that maintains the integrity of the device. The core-portions may form a core for a transformer or inductor. Accordingly, windings way be located proximate the core either before or after its portions are joined together.

The foregoing has outlined, rather broadly, features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
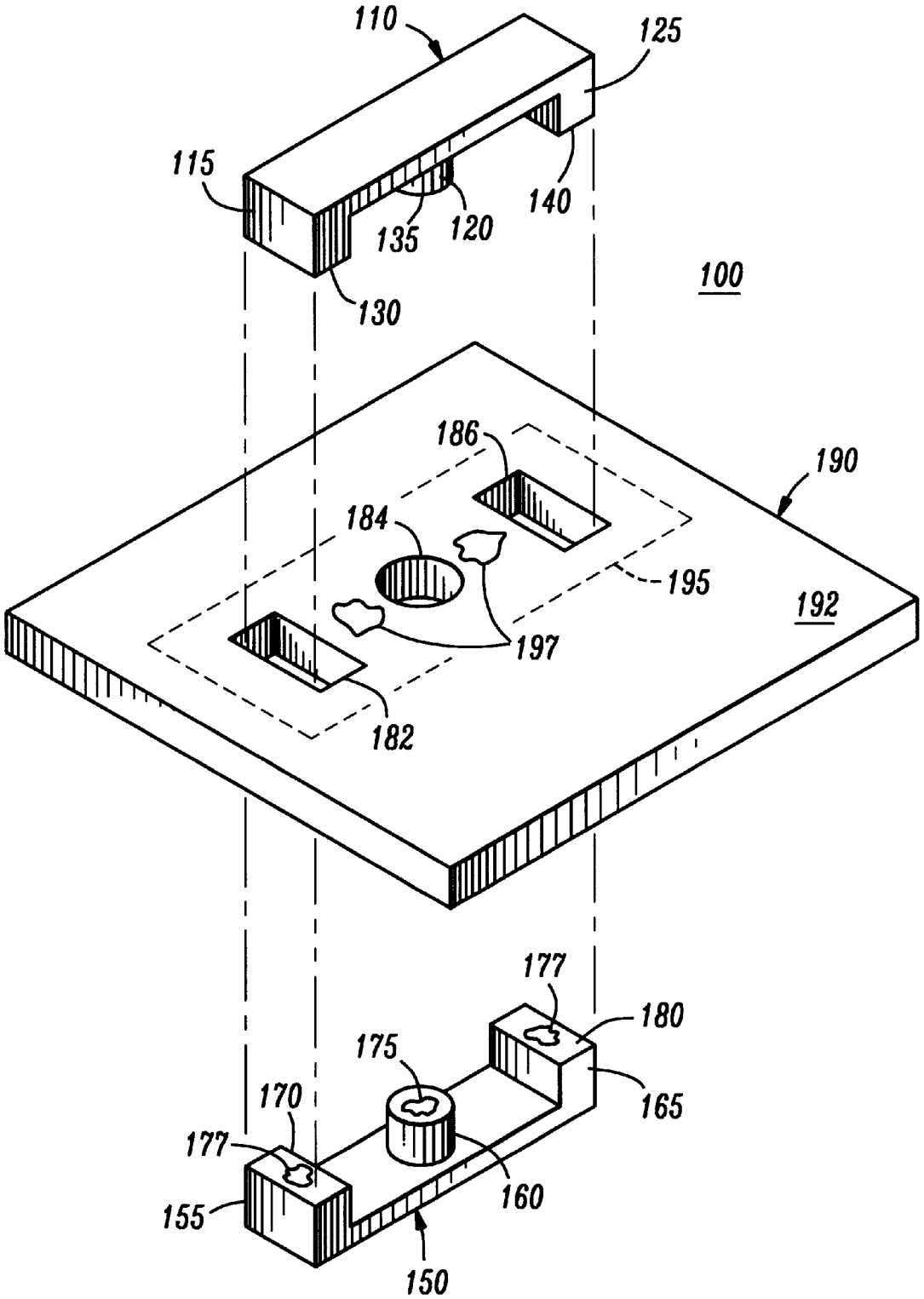
FIG. 1 illustrates an isometric view of an embodiment of a magnetic device constructed according to the principles of the present invention.

Referring initially to FIG. 1, illustrated is an isometric view of an embodiment of a magnetic device 100 (having a first and second core-portion 110, 150) Constructed according to the principles of the present invention. The first and second core-portions 110, 150 of the magnetic device 100 include a plurality of corresponding legs (a first leg 115, second leg 120 and third leg 125 of the first core-portion 110 and a matching first leg 155, second leg 160 and third leg 165 of the second core-portion 150) having opposing end faces (a first end face 130, second end face 135 and third end face 140 of the first core-portion 110 and a first end face 170, second end face 175 and third end face 180 of the second core-portion 150) thereon, respectively. The magnetic core may therefore have a "U" or "E" configuration or any arbitrary configuration that may find particular use in a given application.

The magnetic device 100 also includes a substrate 190 containing a plurality of conductive traces (embodying a plurality of windings) 195 interposed between the first and second core-portions 110, 150. As a result, the footprint of the magnetic device 100 and the interconnection losses between the plurality of windings 195 can be reduced. Alternatively, the plurality of windings may be part of a multi-layer flex circuit. Additionally, more conventional windings may be wound about a bobbin and interposed between the core-portions or may be wound about the core-portions themselves. The first and second core-portions 110, 150 and windings 195, in either case, form a transformer magnetic device 100. Of course, other types of magnetic devices are well within the broad scope of the present invention.

To facilitate placement of the first and second core-portions 110, 150 an adhesive (e.g., a shrink adhesive by Wacker Corporation of Adrian, Mich.) 197 is applies between apertures 182, 184, 186 on a face 192 of the substrate 19). An adhesive (e.g., an epoxy adhesive by Lucent Technologies of Murray Hill, N.J.) 177 is also applied to the first end face 170, second end face 175 and third end face 180 of the second core-portion 150 to facilitate the mating of the first and second core-portions 110, 150 about the substrate 190 proximate the windings 195. Of course, the adhesives may be interchangeably employed and other adhesive materials are well within the broad scope of the present invention.

Figure 2:
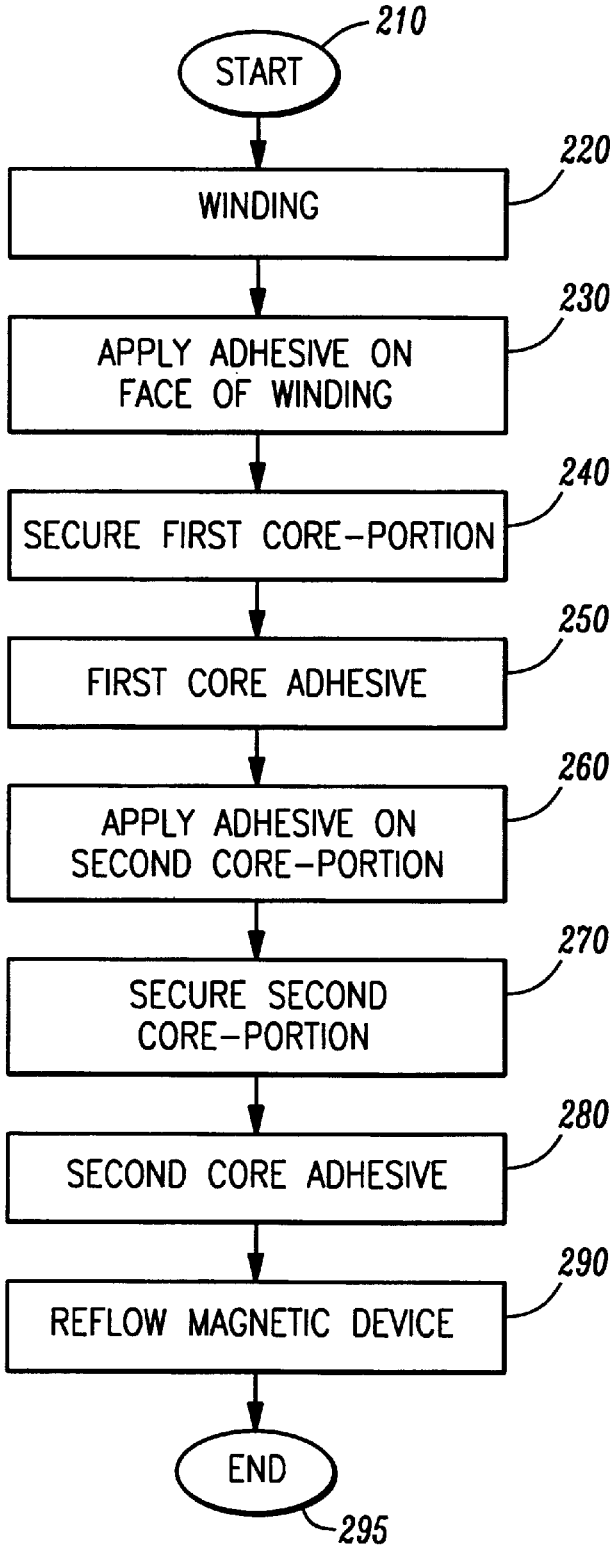
FIG. 2 illustrates a flow diagram of an embodiment of a method of constructing a magnetic device according to the principles of the present invention.

Turning now to FIG. 2, illustrated is a flow diagram of an embodiment of a method of constructing a magnetic device (having a first and second core-portion, the first and second core-portions each having at least one leg respectively) according to the principles of the present invention. The method commences at a start step 210. A planar winding assembly having apertures therethrough is provided at a winding step 220. An adhesive is applied on a face of the planar winding assembly during an apply adhesive on face of winding step 230. The first core-portion (having a first leg and second leg) is adhesively secured to the face of the planar winding assembly with an automated pick and placement tool during a secure first core-portion step 240. The first leg of the first core-portion has a first end face and the second leg of the first core-portion has a second end face. The adhesive between the first core-portion and the planar winding assembly is allowed to cure during a first cure adhesive step 250. The first core-portion and planar winding assembly may then be reversed to expose an opposing face of the planar winding assembly and the first end face and second end face of the first and second leg, respectively, of the first core-portion.

An adhesive is then applied on a first end face and second end face of a first leg and second leg respectively, of a second core-portion during an apply adhesive on a second core-portion step 260. The adhesive may, alternatively or additionally, be applied on the first end face and second end face of the first leg and second leg, respectively, of the first core-portion or on the opposing face of the planar winding assembly. The second core-portion is adhesively secured to the opposing face of tie planar winding assembly with the automated pick and placement tool during a secure second core-portion step 270. The first and second end faces of the first core-portion are adapted to mate with the first and second end faces of the second core-portion through the apertures in the planar winding assembly. The adhesive is curable to provide a bond between the first and second core-portions. Again, the first and second core-portions are secured to the planar winding assembly without substantial compressive forces. The adhesive between the magnetic core (including the first and second core-portion) and the planar winding assembly is allowed to cure during a second cure adhesive step 280. The planar winding assembly and magnetic core are then reflowed with solder during a reflow magnetic device step 290. The process for constructing the magnetic device is therein completed at an end step 295.

Figure 3:
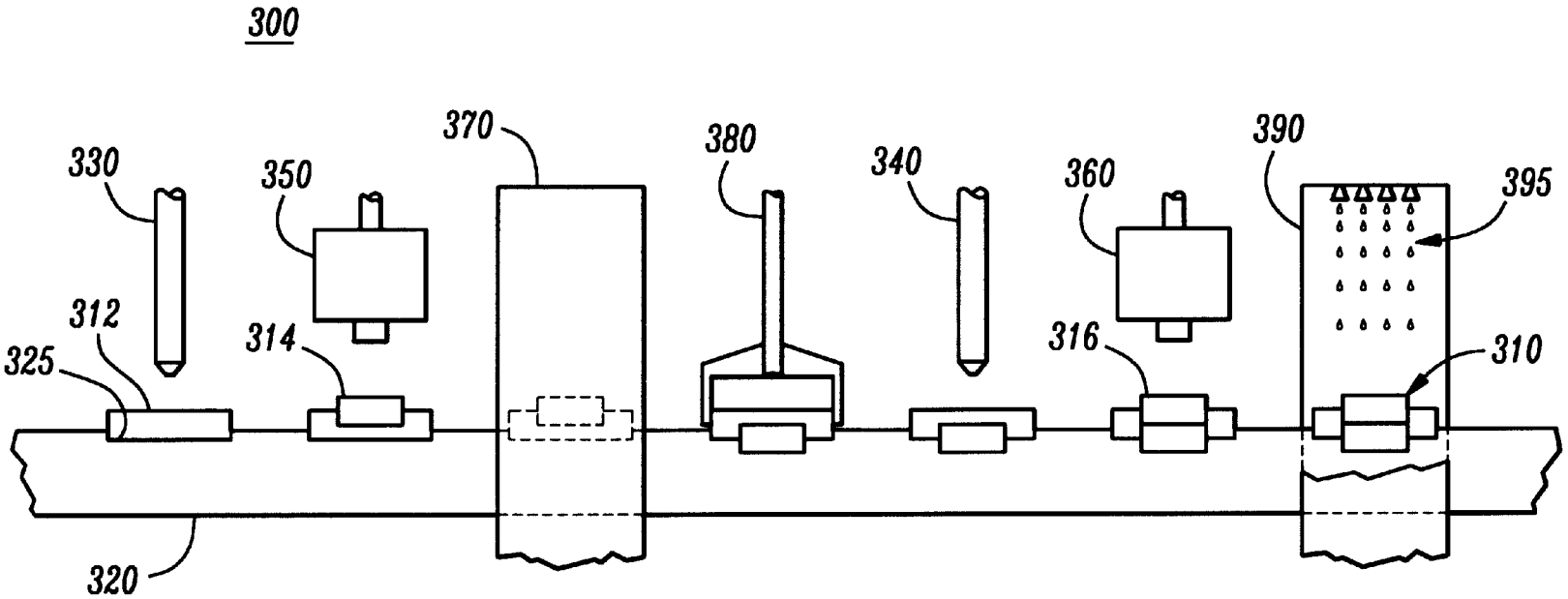
FIG. 3 illustrates a cross-sectional view of an embodiment of a manufacturing tool employable for constructing a magnetic device according to the principles of the present invention.

Turning now to FIG. 3, illustrated is a cross-sectional view of an embodiment of a manufacturing tool 300 employable for constructing a magnetic device 310 according to the principles of the present invention. For an explanation of the components that constitute the magnetic device 310, see the preceding FIGUREs and related description therefor. The tool 300 includes a tray 320, a first and second dispenser 330, 340, a first and second automated pick and place tool or assembly arm 350, 360, an oven (e.g., a convection oven or solder reflow oven) 370, a rotational arm 380 and an oven/reflow device 390. The tray or pallet 340, having a plurality of receptacles (one of which is designated 325) therein, receives a planar winding assemble (as part of, for instance, a substrate of printed circuit board) 312. The first dispenser 330 dispenses an adhesive (not shown) on a face of the planar winding assembly 312. The first automated pick and placement assembly arm 350 automatically secures a first core-portion 314 of a magnetic core to the planar winding assembly 312. The oven 370 cures the adhesive between the planar winding assembly 312 and the first core-portion 314 to facilitate a pond therebetween.

The rotational arm 380 rotates the planar winding assembly 312 and the first core-portion 314 and returns the two components to the tray 320. The second dispenser 340 dispenses an adhesive (not shown) on an opposing face of the planar winding assembly 312 and on at least one end face of a plurality of legs (not shown) of the first core-portion 314. The second automated pick and placement assembly arm 360 automatically secures a second core-portion 316, having a plurality of legs with opposing end faces thereon (not shown), of a magnetic core to the planar winding assembly 312 and the first core-portion 314. The respective legs of the first and second core-portions 314, 316 are joined together through apertures (not shown) in the planar winding assembly 312. The magnetic core is adapted to impart a desired magnetic property to the planar winding assembly 312. The first and second core-portions 314, 316 are secured to one another without substantial compressive forces (e.g., less than about 110% of the weight of a core-portion). The oven/reflow device 390 cures the adhesive between the planar winding assembly 312 and the first and second core-portions 314, 316 and reflows solder 395 over the magnetic device 310.

Of course, those skilled in tie art should recognize that the previously described manufacturing tool is submitted for illustrative purposes only, and other manufacturing tools and processes adapted to automatically construct a magnetic device are well within the broad scope of the present invention.

Figure 4:
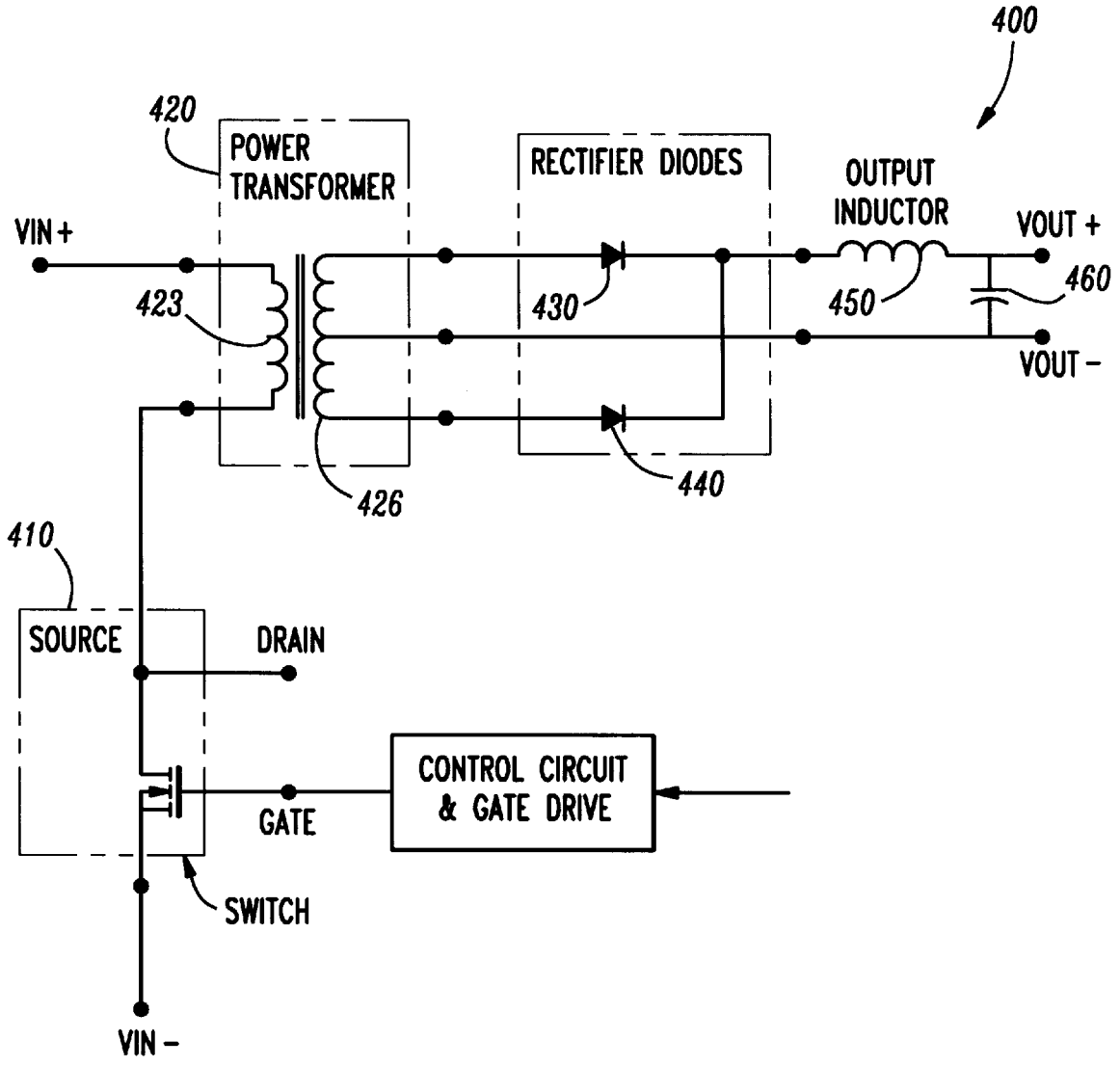
FIG. 4 illustrates a schematic diagram of a power supply employing a power magnetic device constructed according to the principles of the present invention.

Turning now to FIG. 4, illustrated is a schematic diagram of a power supply 400 employing a power magnetic device 420 constructed according to the principles of the present invention. The power supply 400 includes a power train having a conversion stage including a power switching device 410 for receiving input electrical power $V_{IN}$ and producing therefrom switched electrical power. The power supply 400 farther includes a filter stage (including an output inductor 450 and output capacitor 460) for filtering the switched electrical power to produce output electrical power (represented as a voltage $V_{OUT}$). The power supply 400 still further includes the power magnetic device (e.g., transformer) 420, having a primary winding 423 and a secondary winding 426, and a rectification stage (including rectifying diodes 420, 430) coupled between the power conversion stage and the filter stage. The transformer 420 is constructed according to the principles of the present invention as previously described. Again, the power magnetic device 420 and power supply 400 are submitted for illustrative purposes only and other magnetic devices and applications therefor are well within the broad scope of the present invention.

For a better understanding of power electronics including power supplies and conversion technologies see "Principles of Power Electronics," by J. G. Kassakian, M. F. Schlecht and G. C. Verghese, Addison-Wesley (1991). For a better understanding of magnetic devices and construction techniques therefor see "Handbook of Transformer Applications," by William Flanagan, McGraw Hill Book Co. (1986). The aforementioned references are herein incorporated by reference.

Although the present invention has been described in detail, those skilled in the art should understand that they can make various changes, substitutions aid alterations herein without departing from the spirit and scope of the invention in its broadest form.

What is claimed is:

1. A method of manufacturing a magnetic device, comprising:

providing a substrate containing a plurality of conductive traces embodying a plurality of windings;

applying an adhesive on a portion of a face of said substrate; and employing an automated pick and placement tool to adhesively secure a first core-portion of a magnetic core to a second core-portion of said magnetic core and to adhesively secure one of said first and second core-portions to said substrate, said magnetic core adapted to impart a desired magnetic property to said plurality of windings.

2. The method as recited in claim 1 wherein said first and second core-portions are adhesively secured about said substrate proximate said conductive traces.

3. The method as recited in claim 1 wherein said substrate is part of a multi-layer circuit.

4. The method as recited in claim 1 wherein said adhesive is a shrink adhesive.

5. The method as recited in claim 1 wherein said applying further comprises applying said adhesive on portions of opposing faces of said substrate.

6. The method as recited in claim 1 wherein said applying further comprises applying said adhesive on at least a portion of one end face of opposing end faces of a matching pair of legs of said first and second core-portions, said matching pair of legs of said first end second core-portions being joined together through apertures in said substrate.

7. The method as recited in claim 1 further comprising allowing said adhesive to cure after said employing.

8. The method as recited In claim 1 further comprising reflowing solder over said substrate and said magnetic core after performing said employing.

9. The method as recited in claim 1 wherein said plurality of windings comprise primary and secondary windings, said substrate and said magnetic core forming a transformer.

10. A method of manufacturing a magnetic device, comprising:

providing a substrate containing a plurality of conductive traces embodying a plurality of windings, said substrate having apertures therethrough;

disposing a shrink adhesive on a portion of a face of said substrate;

adhesively securing a first core-portion having a first leg and second leg associated therewith to said portion of said face of said substrate with an automated pick and placement tool, said first leg having a first end face and said second leg having a second end face;

disposing a shrink adhesive on a portion of a first end face and second end face of a first leg and second leg, respectively, of a second core-portion; and adhesively securing said second core-portion to an opposing face of said substrate with said automated pick and placement tool, said first and second end faces of said first core-portion adapted to mate with said first and second end faces of said second core-portion through said apertures, said shrink adhesive curable to provide a bond between said first and second core-portions.

11. The method as recited in claim 10 wherein said first and second core-portions are adhesively secured about said substrate proximate said conductive traces.

12. The method as recited in claim 10 further comprising allowing said shrink adhesive to cure after performing said adhesively securing.

13. The method as recited in claim 10 further comprising reflowing solder over said substrate and magnetic core.

14. The method as recited in claim 10 wherein said plurality of windings comprise primary and secondary windings, said substrate and magnetic core forming a transformer.

15. A method of manufacturing a magnetic device, comprising:

providing a substrate containing a plurality of conductive traces embodying a plurality of windings and a magnetic core having first and second core-portions;

applying an adhesive on at least a portion of one of opposing end faces of a matching pair of legs of said first and second core-portions; and employing an automated pick and placement tool to adhesively secure said first core-portion to said second core-portion, said magnetic core located proximate said plurality of windings and adapted to impart a desired magnetic property thereto.

16. The method as recited in claim 15 wherein said first and second core-portions are adhesively secured about said substrate.

17. The method as recited in claim 15 wherein said substrate is part of a multi-layer circuit.

18. The method as recited in claim 15 wherein said adhesive is a shrink adhesive.

19. The method as recited in claim 15 wherein said applying further comprises applying said adhesive on portions of opposing faces of said substrate.

20. The method as recited in claim 15 wherein said matching pair of legs of said first and second core-portions are joined together through apertures in said substrate.

21. The method as recited in claim 15 further comprising allowing said adhesive to cure after said employing.

22. The method as recited in claim 15 further comprising reflowing solder over said substrate and said magnetic core after performing said employing.

23. The method as recited in claim 15 wherein said plurality of windings comprise primary and secondary windings, said substrate and said magnetic core forming a transformer.

* * * * *